US005567106A

United States Patent [19]

Gassner

[11] Patent Number: 5,567,106

[45] Date of Patent: Oct. 22, 1996

[54] APPARATUS FOR CHARGING A TRASH SORTING DEVICE WITH THE CONTENTS OF TRASH BAGS

[76] Inventor: Benno Gassner, P.O. Box 60, DE-85655 Grosshelfendorf, Germany

[21] Appl. No.: 275,765

[22] Filed: Jul. 15, 1994

[30] Foreign Application Priority Data

Jul. 16, 1993 [DE] Germany ..... 43 23 952.8

[51] Int. Cl.[6] ..... B65B 69/00

[52] U.S. Cl. ..... 414/412; 241/200; 241/DIG. 38

[58] Field of Search ..... 414/412; 209/930; 241/DIG. 38, 200, 202

[56] References Cited

U.S. PATENT DOCUMENTS

| | | | |
|---|---|---|---|
| 3,891,105 | 6/1975 | Cerroni | 414/412 |
| 4,119,227 | 10/1978 | Hafner et al. | 414/412 |
| 4,515,509 | 5/1985 | Frisz | 414/412 |
| 5,253,971 | 10/1993 | Weinlader | 414/412 |
| 5,267,823 | 12/1993 | Roman | 414/412 |
| 5,282,713 | 2/1994 | Lande | 414/412 |
| 5,352,082 | 10/1994 | Bennison | 414/412 |
| 5,368,432 | 11/1994 | Schoenhard | 414/412 |

FOREIGN PATENT DOCUMENTS

| | | | |
|---|---|---|---|
| 2325203 | 8/1974 | Germany . | |
| 1265092 | 10/1986 | U.S.S.R. | 414/412 |
| 1284896 | 1/1987 | U.S.S.R. | 414/412 |
| 2206297 | 1/1989 | United Kingdom . | |

*Primary Examiner*—David A. Bucci
*Attorney, Agent, or Firm*—Kirkpatrick & Lockhart LLP

[57] ABSTRACT

An apparatus for charging a trash sorting device with the contents of trash bags has a feed apparatus of the trash bags connected to an inclined conveyor belt suitable for bearing and transporting trash bags, the upper end of which is located above the charging point of a conveyor which traverses the sorting area. Located above and near the upper end of the conveyor belt is a deflector rake which can be swiveled around an axle which traverses the conveyor belt, the tines of which rake when in the pick up position approach the conveyor belt at a downward angle in the direction opposite the direction of transport of the belt and can be moved from this pick up position opposite the direction of transport to a reject position above the conveyor belt. The deflector rake can be driven in a back-and-forth motion between the pick up position and the reject position. Ripping devices facing the trash bags extend in the direction of transport from a bearing downstream from the deflector rake, project through the gaps between the tines with their distance from the conveyor belt increasing in the direction opposite the direction of transport, and which from an initial position can be moved together against a return force around an axle traversing the conveyor belt, whereby transport along the feed apparatus can be regulated as a function of the angular position of the ripping devices relative to this initial position.

19 Claims, 7 Drawing Sheets

APPARATUS FOR CHARGING A TRASH SORTING DEVICE WITH THE CONTENTS OF TRASH BAGS

The invention relates to an apparatus for charging a trash sorting device with the contents of trash bags.

Environmentally-friendly trash disposal requires that the contents of trash bags be sorted. Sorting must be performed visually, thus the conventional method is to place the trash which has been removed from the bags on a sorting conveyor, which carries the trash past the personnel performing the sorting.

It is the prior art that the trash bags are manually opened and emptied on the sorting conveyor. Automation of this step has failed due to the fact that the trash bags are not evenly filled, so that an automatic apparatus cannot be expected to maintain an even supply of trash on the sorting conveyor. Furthermore, there is also a risk of jams and blockages when using automatic devices to empty the trash bags and transfer the trash to the sorting device due to the widely varying contents of the trash bags.

The object of the invention is to create a device of the type described above with which material jams are automatically cleared so that incoming trash bags can be fed into the apparatus without regard to possible jams or blockages. The bags are automatically opened and they and their contents are transferred relatively evenly to the sorting conveyor.

To achieve this object, the invention teaches that an apparatus for charging a trash sorting device with the contents of trash bags has at the end of the feed apparatus for the trash bags an inclined conveyor belt suitable for bearing and transporting trash bags and their contents, which conveyor belt ends with its upper end above the charging point of a conveyor which traverses the sorting area, that above and near the upper end of the conveyor belt, swiveling around an axle traversing the conveyor belt, is a deflector rake whose tines when in the pick up position approach the conveyor belt at a downward angle in the direction opposite the direction of transport of the conveyor belt and which deflector rake can be moved from this pick up position opposite the direction of transport to a reject position above the conveyor belt, that the deflector rake can be driven in a back-and-forth motion between the pick up position and the reject position, and that ripping devices facing the trash bags extend in the direction of transport from a bearing on the deflector rake, project through the gaps between the tines with the distance between the ripping devices and the conveyor belt increasing in the direction opposite the direction of transport, and which from an initial position can be moved against a return force around a common axle traversing the conveyor belt, and that transport along the feed apparatus can be regulated by means of a device which monitors the flow of material along the conveyor belt.

The feed apparatus transports the trash bags to the inclined conveyor belt, where they move toward the ripping devices and are carried into the gap between the ripping devices and the conveyor belt, which gap tapers in the direction of transport, until reaching the deflector rake. The reject motion of the deflector rake tears the trash bags open on the ripping devices so that the torn trash bags and their contents subsequently drop from the end of the conveyor belt onto the sorting device. Depending on the type of trash, the deflector rake can complete several oscillations before the trash is completely emptied and leaves the area of the deflector rake. In one preferred embodiment, the amount of trash fed to the sorting device per unit of time can be adjusted by changing the distance between the deflector rake and the conveyor belt.

GB-PS 22 06 297 discloses a mechanism which also has an inclined conveyor and a ripping apparatus realized as a revolving chain link belt with tines and which is swivel mounted by means of its own weight such that it can swivel toward the conveyor. A disadvantage of this prior art apparatus is that if the trash bags are unevenly filled, an extremely full trash bag can prevent the ripping device from engaging a less full trash bag, allowing this bag to pass the ripping apparatus unopened.

DE-OS 23 25 203 discloses a ripping apparatus located above a horizontal trash bag conveyor. This ripping device has hooks which can be raised and lowered. When lowered, the hooks stop the trash bags and a group of blades move essentially in the direction of movement toward the hooks and cut the trash bags. The blades are then moved back in the opposite direction, whereby the blades can swing out due to ratchet-like bearing when striking an object. In the end phase of this rearward motion, the motion is transferred via a tie rod to the hooks, which are thereby raised out of the transport path of the materials on the conveyor. This apparatus, too, does not guarantee that all of the trash bags transported on the conveyor are reliably opened since the process sequence includes phases in which the transport path is wide open.

With the apparatus as claimed by the current invention, a suitable sensor, such as a tactile sensor, detects when a jam forms in the area of the deflector rake and the ripping devices, or when one a larger trash bag or a group of trash bags enters this area, whereby the speed of the feed apparatus can be reduced or the feed apparatus can be shut down entirely. A preferred embodiment teaches that transport along the feed apparatus can be regulated as a function of the angular position of the ripping devices relative to their initial position, whereby each of the ripping devices is equipped with a lever and a tactile sensor associated to all of the levers which helps regulate transport is located in the path of these levers. Additional trash bags are only allowed onto the in inclined conveyor when the monitoring sensor indicates that the jam has been cleared or sufficiently reduced.

In the event that the trash bags contain bulky items which are unable to pass the deflector rake, the pressure against the deflector rake may exceed a specified limit. In this case, the apparatus can be configured according to an advantageous design so that the tines of the deflector rake are mounted on a lever, which itself can be swiveled around the swivel pin of a deflector rate, in such a manner that the tines can be moved around an axle parallel to the swivel pin of the rake and which axle is in front of the swivel pin and the free ends of the tines when in the pickup position opposite the direction of transport, and that in the event of an overload the tines can be held in the initial position by means of a spring to which tension can be applied, whereby the tines are lifted from the conveyor belt when tension is applied to the spring.

Another possible solution teaches that the tines of the deflector rake are mounted on a lever, which itself can be swiveled around the swivel pin of the deflector rake, in such a manner that the tines can be moved around an axle which is parallel to the swivel pin of the rake and upstream of the swivel pin and the free ends of the tines when the deflector rake is in the pick up position opposite the direction of transport, and which tines can by means of a control mechanism be moved in the direction of transport from their initial position for a specified period of time, that the control mechanism is tripped by means of a signal given by a sensor downstream from the deflector rake if the flow of material on the conveyor belt is interrupted for a specified period of time.

The tines of the deflector rake preferably approach the conveyor belt at a slightly obtuse angle opposite the direction of transport, and that their free ends are bent in such a manner that they are inclined at a greater angle opposite the direction of transport of the conveyor belt. This ensures that the deflector rake can get securely under the trash bags.

Another appropriate embodiment teaches that the ripping devices are realized as cutter bars equipped with cutting teeth, but they can also be equipped with motor-powered cutting or ripping tools. The ripping devices can be equipped with motor-powered saw blades or chains, for example. One advantageous refinement teaches that the motor-powered ripping tools can be driven in a back-and-forth motion.

A particular advantageous embodiment teaches that the ripping tools move at least in the direction of transport when the deflector plate moves from its pick up position into its reject position.

It is preferable for transport along the conveyor belt and the oscillation of the deflector rake to be coordinated so that all of the arriving trash bags are encompassed within the oscillating motion. It has proved appropriate that the grabs for the trash bags located at even intervals along the conveyor belt be moveable and that the drive systems be designed in such a manner that the deflector rake completes at least one, but preferably two, full oscillations in the time required by the grab to travel a distance corresponding to this interval, whereby bags which are only partly full can also be engaged.

A further advantageous embodiment teaches that the initial position of the ripping devices is adjustable.

A particularly advantageous embodiment teaches that the upper end of the conveyor belt in the range of action of the ripping devices is comprised of grate bars which are separated from one another and run transverse to the direction of transport, whereby preferably two groups of grate bars in which the bars are parallel to the bars of the same group are placed in such a manner that the ends of the bars facing in the direction of transport are adjacent to one another in the center of the conveyor belt. This allows small objects, such as bottle caps, to pass through the gaps between the grate bars to be transported separately and possibly be disposed of as tailings without placing an undue burden on the visual sorting process. The diagonal arrangement of the grate bars facilitates the transport of parts which partly catch in the gaps between the grate bars but because of their size cannot fall through these gaps.

Several embodiments of the invention are described in greater detail below with reference to the attached drawings.

Figure 1:
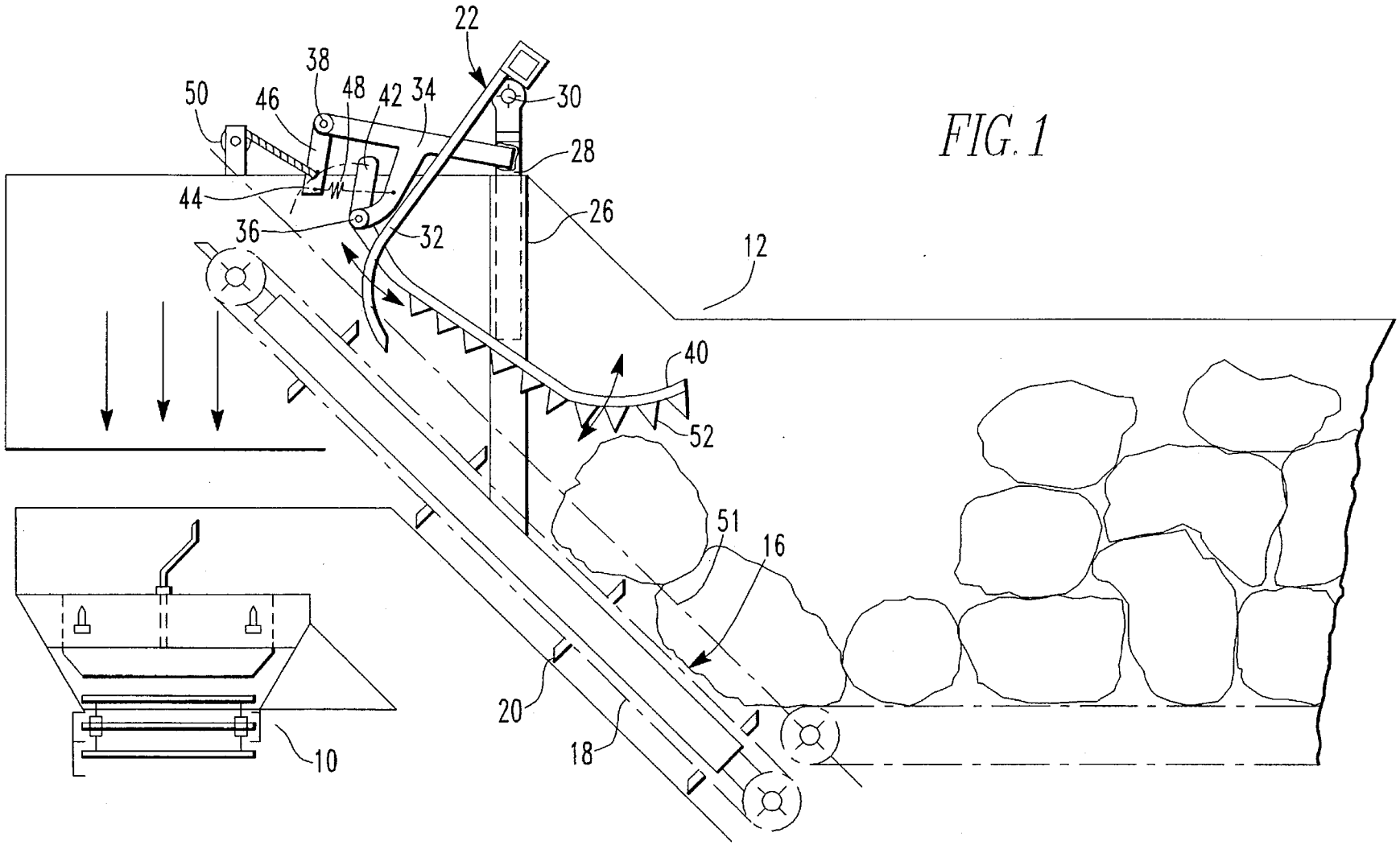
FIG. 1 shows a vertical section through one embodiment of the apparatus as claimed by the invention together with a trash sorting belt.
Figure 5:
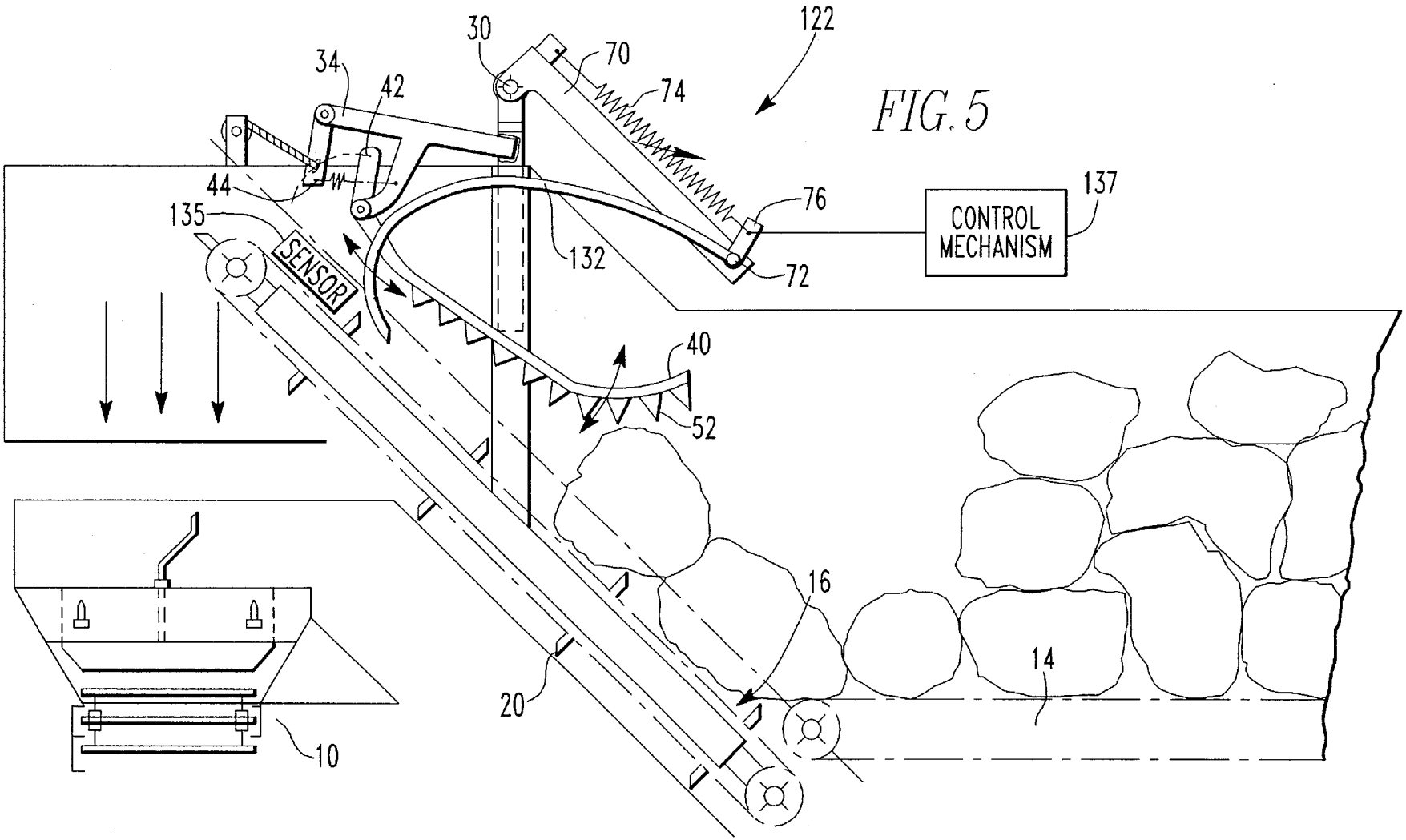
FIG. 5 shows a view corresponding to FIG. 1 of a second embodiment of the apparatus as claimed by the invention.

In FIGS. 1 and 5, 10 designates a trash sorting device in the form of a trash sorting belt on to which the trash to be sorted is discharged.

The trash to be sorted arrives in closed trash bags, which is why the object of the apparatus as claimed by the invention, designated 12, is to automatically engage the bags, open them and discharge the trash and the bags onto the sorting device 10, whereby jams and blockages in the area of the apparatus 12 must be avoided and it must be possible to adapt the discharge of trash onto the sorting device 10 to the processing capacity of this device.

The trash bags are simply placed on a feed apparatus 14 in the form of an endless belt or scraper floor. This feed device 14 carries the trash bags to an inclined conveyor belt 16, realized in the example shown as a scraper floor, which is transversed in regular intervals in the direction of transport by sequential grab 20 connected by means of drive chains 18. The bags transported to the conveyor belt 16 by means of the feed apparatus 14 are engaged by the grab strips 18 and pushed upward on the conveyor belt 16, where their travel is delimited by a deflector rake 22. The feed apparatus 14 and the conveyor belt 16 is enclosed by side walls on both sides so that the trash bags travel as if in a canal. The basic design—not shown in greater detail—of the apparatus 12 includes two vertical guides 26 on both sides of the conveyor belt 16 which serve as guides for vertically adjustable bearing columns 28, on the upper ends of which the deflector rake 22 is mounted in such a manner that it can swivel around an axle 30 running horizontal to the direction of motion of the conveyor belt 16, which deflector rake 22 can be moved back and forth in an oscillating motion between the pick up position shown in FIGS. 1 and 5 and a reject position placed with respect to this pick up position in a direction which is opposite to the direction of transport of the conveyor belt by means of a drive mechanism not shown in further detail.

When the deflector rake 22 of the embodiment shown in FIG. 1 is in the pick up position, the tines 32 of the deflector rake approach the conveyor belt 16 at a slightly obtuse angle opposite the direction of transport, whereby the free ends of the tines are bent more sharply opposite the direction of transport and inclined toward the conveyor belt so that they can extend under the arriving trash bags regardless of the size of the bag.

A bearing strap 34 is fastened to each bearing column 28 below the bearing for the deflector rake 22, whereby axles 36 and 38, respectively, are located between the bearing straps 34 at various intervals downstream from the tines of the deflector rake 22. The axle 36 is placed at a much smaller distance above the conveyor belt 16 than the axle 30 of the deflector rake 22. Swivel mounted to this axle 36 is a group of ripping devices 40, each of which extends between the gaps between the tines 32 which, when in an initial position adjacent to the conveyor belt 16, move away from the conveyor belt 16 as they extend in the direction opposite the direction of transport, whereby the free ends of the ripping devices 40 can be bent away from the conveyor belt 16 to ensure that no matter what their position, the trash bags on the conveyor belt are carried into the gap between the ripping devices 40 and the conveyor belt 16. The ripping devices 40 are extended beyond the axle 36 approximately in the direction of transport to form levers 42. Depending on the position and the size of the trash bags moving along the conveyor belt 16, the arriving bags can sweep one or more ripping devices 40 in a counterclockwise direction out of their initial position shown in FIG. 1. By means of this swivel motion, the lever 42 of that ripping device which was swept from its initial position is moved against a stop tube 44, which is mounted on arms 46 which can swivel around the axle 38 and which are returned to the initial position by means of a tension spring 48 connected to one of the bearing straps 34 and the corresponding arm 46. The swing of the stop apparatus defined by the arms 46 and the stop tube 44 around the axle 38 is determined by that ripping mechanism 40 executing the greatest swing around the axle 38 of all ripping mechanisms in the group. This swing is characteristic for the filling of the gap between the ripping devices 40 and the conveyor belt 16. To prevent jams or a blockage, the swing of the stop apparatus 44, 46 is used to control the running speed of the feed apparatus 14. Any type of process can be used, e.g., the regulating variable can be transmitted electrically or mechanically, as shown. For mechanical transmission, the tube 44 is connected to a tackle line which is passed over a deflection roll 50, which tackle line acts on the drive of the feed apparatus 14, reducing its speed or bringing it to a standstill, so that transport of the trash can be slowed or interrupted entirely.

By means of the deflector rake 22 drive system which is not shown in the drawing, the deflector rake is moved counterclockwise into a reject position, whereby the deflector rake moves trash bags against the ripping or cutting tools of the ripping devices 40, upon which the rake then returns to the pick up position.

Figure 2:
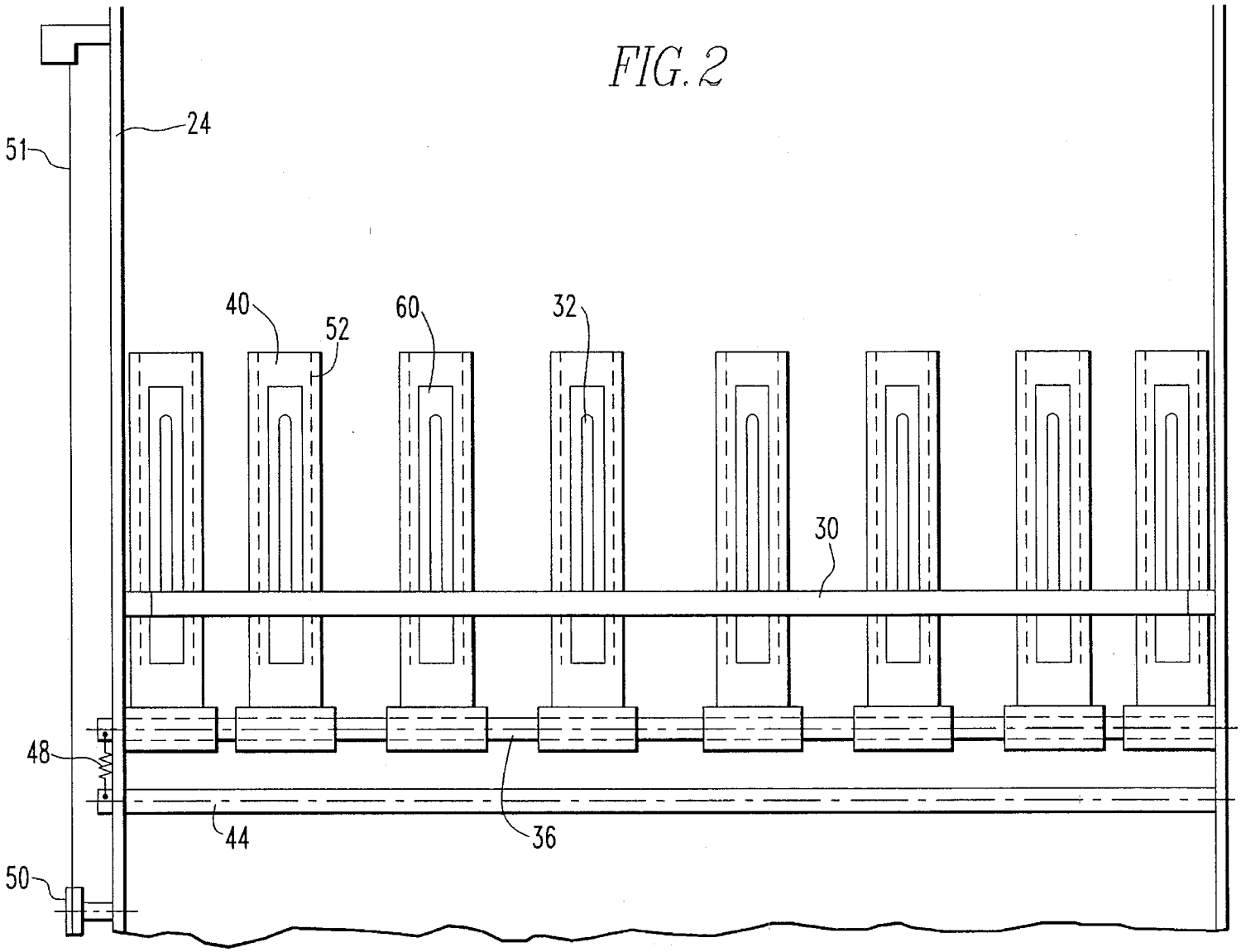
FIG. 2 shows a top view of one portion of the discharge end of the apparatus with an initial variant of the ripping devices.

These ripping or cutting tools can be of any type. For example, the ripping devices can, as shown in FIGS. 1, 2 and 5, can be configured as cutter bars equipped with cutting blades 52. This makes it possible to use motor-powered groups of blades which can be moved in relation to one another.

Figure 3:
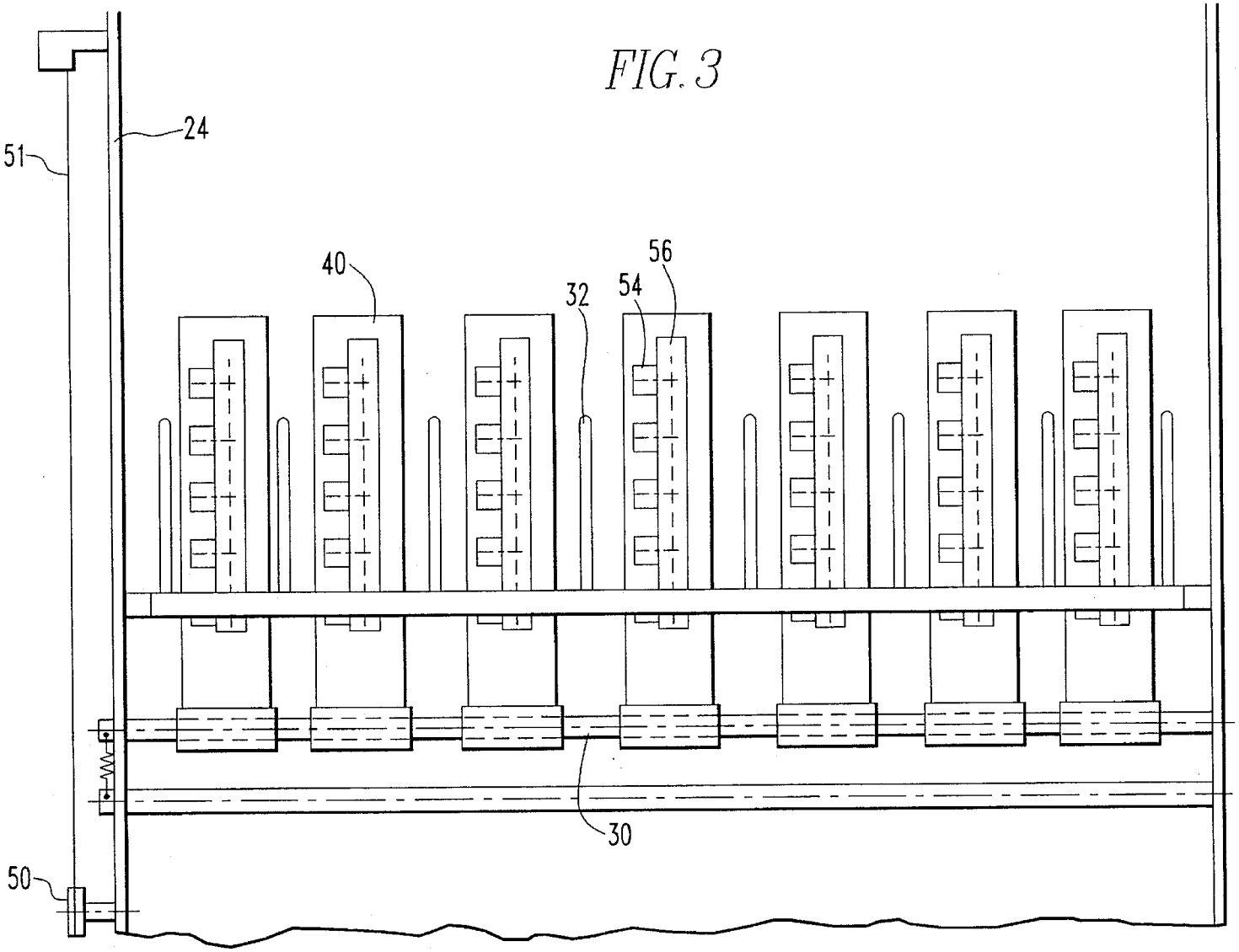
FIG. 3 shows the same view as in FIG. 2 with a second variant of the ripping device.
Figure 4:
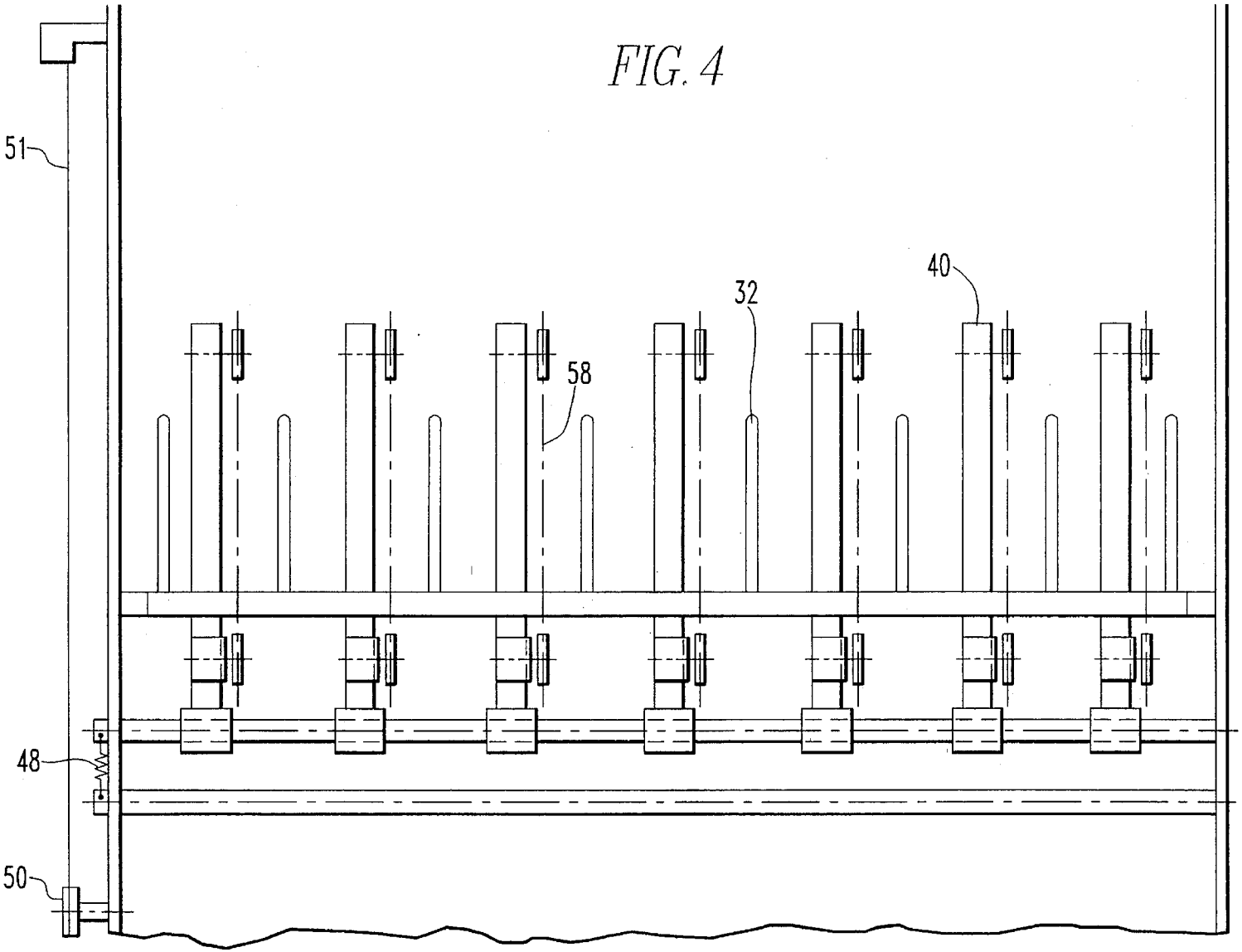
FIG. 4 shows the same view as in FIGS. 2 and 3 with a third variant of the ripping device.

However, it is also possible to equip the ripping devices 40 with saw blades 56 (FIG. 3) powered by individual motors 54 or with powered, revolving saw chains 58 having ripping teeth.

With the configuration shown in FIG. 2, the ripping devices 40 are in the form of cutter bars, each of which has an opening 60 through which the tines of the deflector rake 22 can extend.

A back-and-forth motion of the cutting or ripping tools is preferred so that the bags can be opened and emptied as quickly and efficiently as possible. The ripping action is intensified if the cutting or ripping tools are moved in the direction of transport when the deflector rake 22 is moved in the direction opposite the direction of transport.

Because the conveyor belt 16, the deflector rake 22 and the ripping devices 40 continue to function if the feed apparatus 14 is shut down the material collected between the conveyor belt 16 and the ripping devices 40 continues to be discharged onto the sorting device, whereby the flow of material can be adjusted as function of time to the sorting speed by adjusting the bearing columns 28, because this makes it possible to set the distance between the ends of the tines and the conveyor belt 16 and thus the throughput cross-section of the deflector rake 22 when in the initial position.

Feeding of the trash bags onto the conveyor belt 16 resumes as soon as the ripping devices 40 again approach their initial position.

If trash bags contain relatively bulky trash, it is appropriate that the deflector rake 22 can swing out in a clockwise direction from its initial position shown in the drawing when a specified pressure in the direction of transport is exceeded. This is not possible with the design shown in FIG. 1; if the deflector rake 22 were to move clockwise from the initial position shown, the tines would strike the conveyor belt 16, blocking the throughput cross-section.

Another embodiment of the deflector rake 22 is therefore necessary, such as is shown in FIG. 5 and designated 122. The deflector rake 122 consists of two parts, namely a lever 70 mounted on the mounting columns 28 in such a manner that lever can move around the axle 30, to which lever 70 the tines 132 are mounted in such a manner that they can swivel around an axle 72 parallel to axle 30. A spring 74 is located between a lever 76 rigidly connected to the tines 132 and that end of the lever 70 adjacent to the axle 30. This spring 74 pulls the tines 132 into an end position against the lever 70, which position is shown in FIG. 5 and is designated the initial position of the tines, in which position the free ends of the tines 132 assume the same position relative to the axle 30 and the conveyor belt 16 when the deflector rake 122 is in the pickup position as dose the free ends of the tines 132 when the deflector rake 22 shown in FIG. 1 is in the pickup position. The tines 132 remain in this initial position even during the oscillating motion of the deflector rake between the pickup position and the reject position as long as the torque around the axle 72 defined by the spring 74 is not exceeded.

As soon as a bulky object is not able to pass the deflector rake 122 area in the direction of transport with the rake in the pickup position and the conveyor pressure exceeds the torque defined by the spring 74, the tines 132 are swung out clockwise with respect to FIG. 5 by the tension of the spring, and immediately lifted from the conveyor belt 16 because the axle 72 opposite the direction of transport, is at some distance from the free end of the tines.

One variant here teaches that a signal is triggered by means of an electric eye 135 located downstream of the deflector rake 122 if no material passes the deflector rake 122 area within a specified period of time. The signal can activate a control mechanism 137 which briefly swings the tines out clockwise with respect to the lever 70 so that the objects blocking the tine area can pass under the elevated tines.

Figure 6:
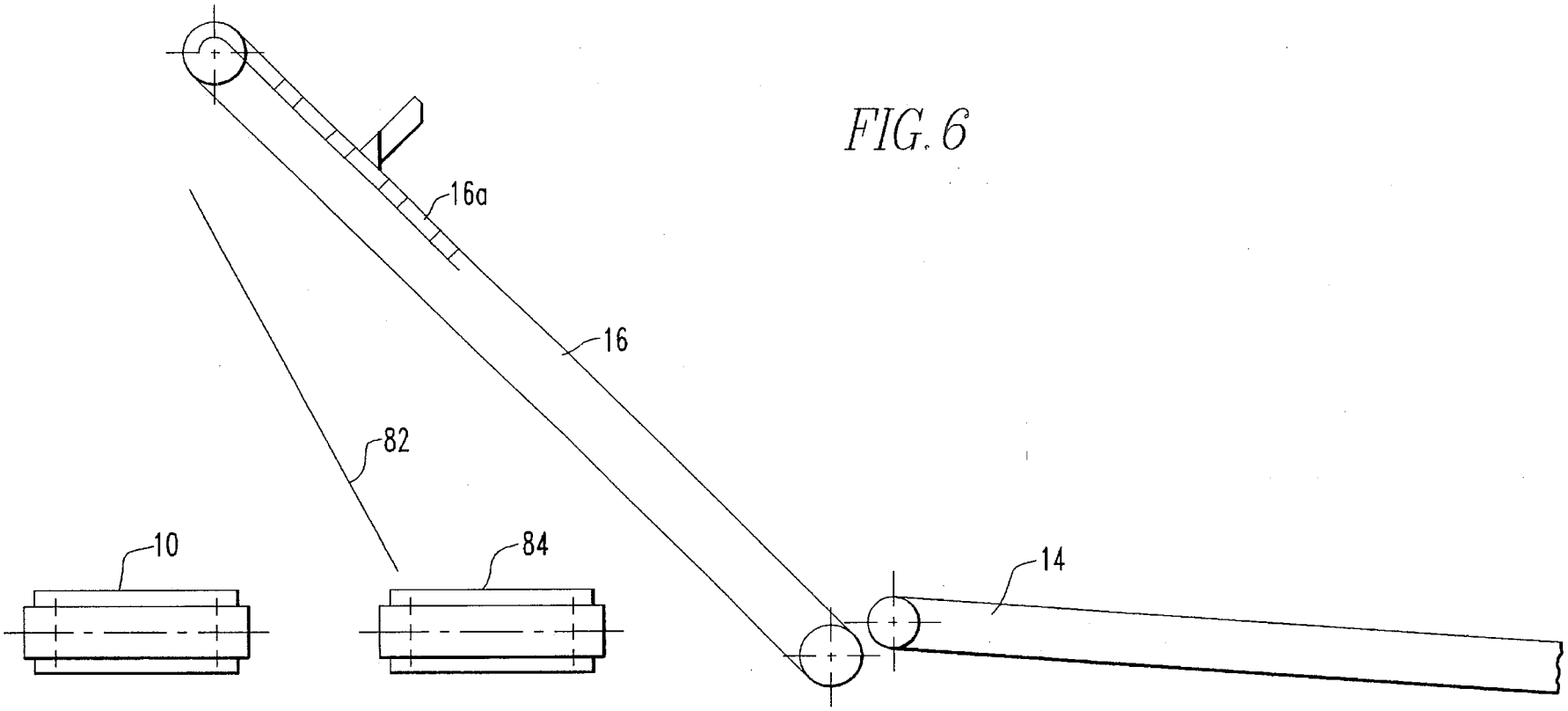
FIG. 6 shows a schematic side view of one variant of the apparatus with automatic separation of small articles.
Figure 7:
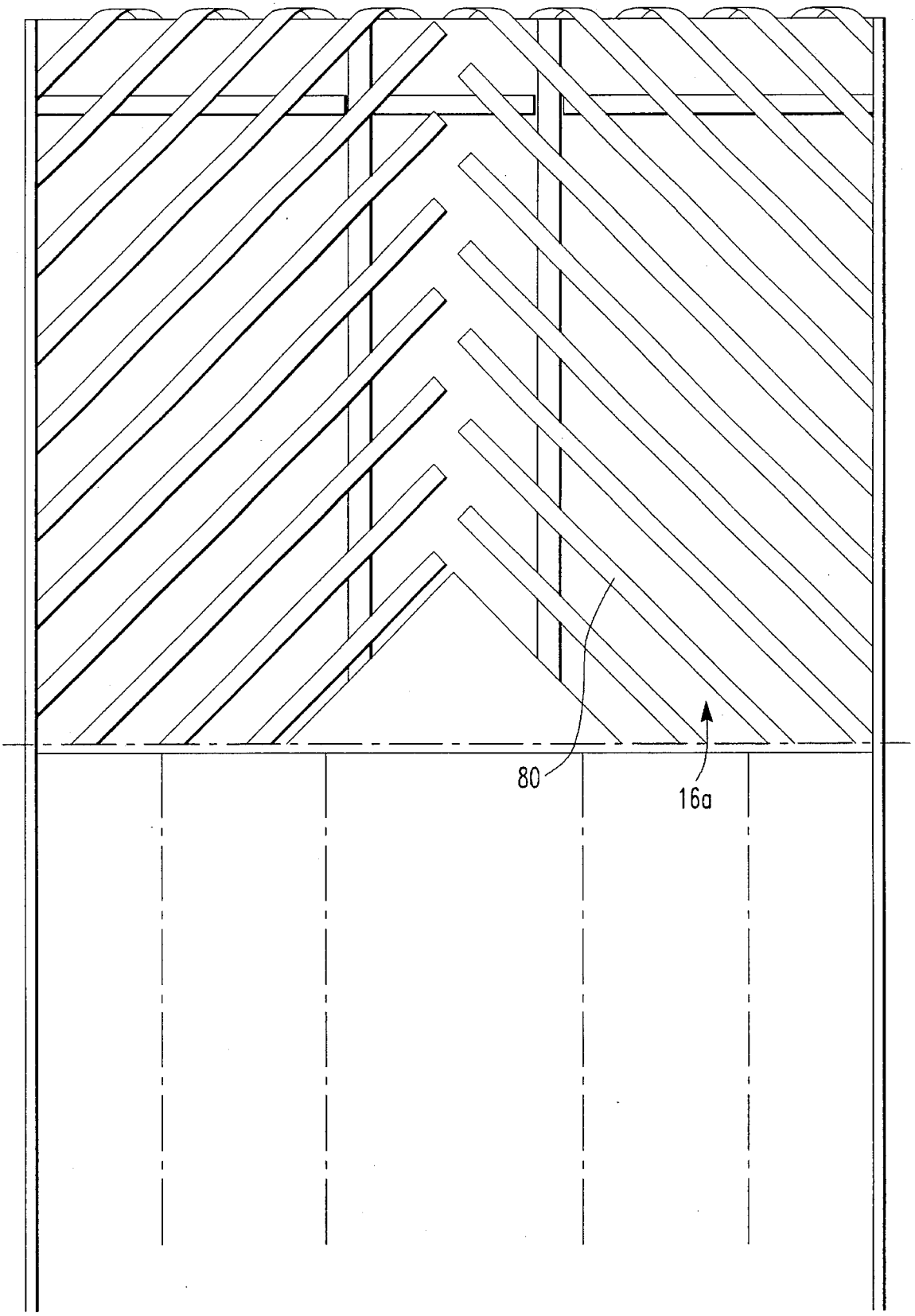
FIG. 7 shows the upper end of the conveyor belt with the apparatus shown in FIG. 6.

FIG. 6 shows that there is an open-worked section **16*a* at the upper end of the conveyor belt 16. As shown in a top view in FIG. 7, this section consists of grate bars 80 which run transverse to the direction of transport and which are divided into two groups on each side of the longitudinal center line of the conveyor belt and the ends of the grate bars 80 facing the direction of transport are adjacent to one another in the center of the conveyor belt 16. The distance between the grate bars 80 is chosen so that prior to sorting, any small parts, such as bottle caps, can fall through the gaps between the bars onto an inclined plane 82, from which move into collection containers or onto a conveyor belt 84**, by means of which they are removed and possibly sent to a dump as trash residue.

By means of the diagonal arrangement of the bars, parts which jam in the gaps between the bars can be pushed along in the direction of transport to the upper end of the conveyor belt and discharged onto the trash sorting belt 10.

What is claimed is:

1. An apparatus for charging a trash sorting device with contents of trash bags, having a feed apparatus, and the trash sorting device having a sorting conveyor, the sorting conveyor traversing a sorting area, and the sorting conveyor having a charging point, comprising:

(a) an inclined conveyor belt suitable for bearing and transporting trash bags and their contents, which conveyer belt having an upper end above the charging point of the sorting conveyor, having a lower end near the feed apparatus, said inclined conveyor belt having a direction of transport which is towards the upper end;

(b) a deflector rake having tines, said tines having gaps therebetween, and said deflector rake located a distance above the inclined conveyor belt and near the upper end of the inclined conveyor belt, said deflector rake swiveling around a first axle traversing the conveyor belt, said tines having a free end and a pickup position, and when in the pick up position the free end of the tines approaches the inclined conveyor belt at a downward angle in a direction opposite the direction of transport of the inclined conveyor belt and said deflector rake can be moved from the pick up position to a reject position above the inclined conveyor belt, the deflector rake driveable in a back-and-forth motion between the pick up position and the reject position;

(c) ripping devices facing the trash bags and extending in a direction opposite the direction of transport, and a distance from the deflector rake, with a distance from the conveyor belt increasing in the direction opposite the direction of transport, said ripping devices projecting through the gaps in the tines, said ripping devices can be moved from an initial position, against a return force, and around a common second axle traversing the inclined conveyor belt, said second axle being mounted at a bearing post positioned downstream of and a distance from the deflector rake; and (d) a device which monitors the flow of material along the conveyor belt and which regulates transport along the feed apparatus.

2. The apparatus as claimed in claim 1, wherein the distance between the deflector rake and the inclined conveyor belt is adjustable.

3. An apparatus as claimed in claim 1, wherein said deflector rake comprising a lever having a first end and a second end, and the tines of the deflector rake are mounted on the first end of said lever via a third axle, said lever can be swiveled around the first axle, said first axle being located at the second end of the lever, the tines can be moved around the third axle which is parallel to the first axle and upstream of both the first axle and the free ends of the tines when the deflector rake is in the pick up position, and the tines are biased onto the pick up position by means of a spring to which tension can be applied in the event of overload.

4. The apparatus as claimed in claim 1, wherein said deflector rake comprising a lever having a first end and a second end, and the tines of the deflector rake are mounted on the first end of said lever, via a third axle, said lever can be swiveled around the first axle, the tines can be moved around the third axle which is parallel to the first axle, said first axle being located at the second end of said lever and the third axle is in front of the first axle and the free ends of the tines when in the pick up position, and further comprising a control mechanism which can move said tines in the direction of transport away from their initial position for a specified period of time, the control mechanism receiving a signal from a sensor located downstream from the deflector rake, said control signal indicative of whether the flow of material on the conveyor belt is interrupted for a specified period of time.

5. The apparatus as claimed in claim 1, wherein the tines of the deflector rake approach the inclined conveyor belt at a slightly obtuse angle and is opposite the direction of transport, said tines having free ends proximate the inclined conveyor belt, said free ends being bent in such a manner that they are inclined at an angle greater than the angle of the tines and in a direction opposite the direction of transport of the conveyor belt.

6. The apparatus as claimed in claim 1, wherein the ripping devices comprise cutter bars equipped with blades.

7. The apparatus as claimed in claim 1, wherein the ripping devices are equipped with motor-powered ripping tools.

8. The apparatus as claimed in claim 7, wherein the ripping devices are equipped with motor-powered saw blades.

9. The apparatus as claimed in claim 7, wherein the ripping devices are equipped with motor-powered saw chains.

10. The apparatus as claimed in claim 7, wherein the motor-powered ripping tools can be driven in a back-and-forth motion.

11. The apparatus as claimed in claim 10, wherein the ripping tools move at least in the direction of transport when the deflector rake moves from its pick up position to its reject position.

12. The apparatus as claimed in claim 1, wherein the movement of the deflector rake from the pick up position to the reject position and back to the pickup position defines an oscillation, wherein transport along the conveyor belt and the oscillation of the deflector rake are coordinated.

13. The apparatus as claimed in claim 12, further comprising moveable grabs located on said inclined conveyor belt for grabbing trash bags, said grabs located at even intervals along the conveyor belt, and further comprising drive equipment for driving said inclined conveyor belt, said drive equipment being designed in such a manner that the deflector rake completes at least one oscillation in a period of time it takes the drive equipment to move a grab over a distance corresponding to one of said intervals.

14. The apparatus as claimed in claim 13, wherein the drive equipment is designed in such a manner that the deflector rake completes at least two oscillations in the time it takes the drive equipment to move a grab over a distance corresponding to one of the intervals.

15. The apparatus as claimed in claim 1, wherein the initial position of the ripping devices is adjustable.

16. The apparatus as claimed in claim 15, wherein an angle formed by the actual position of the ripping devices and the initial position of the ripping devices defines an angular position, and wherein the feed apparatus can be controlled as a function of the angular position of the ripping devices.

17. The apparatus as claimed in claim 15, wherein each of the ripping devices is equipped with a lever, and that a tactile sensor associated with all of the levers and which helps to regulate transport, is located in the path of these levers.

18. The apparatus as claimed in claim 1, wherein a portion of the upper end of the conveyor belt located proximate the ripping devices is comprised of a plurality of grate bars which are separated from one another and which run transverse to the direction of transport.

19. The apparatus as claimed in claim 18, further comprising two groups of grate bars, each grate bar having a downstream end, in which the two groups of grate bars are located side by side in the direction of transport, grate bars in the same group are parallel to each other, and the grate bars are placed in such a manner that the downstream ends of the bars are adjacent to one another in the center of the conveyor belt.

* * * * *

UNITED STATES PATENT AND TRADEMARK OFFICE

CERTIFICATE OF CORRECTION

PATENT NO. : 5,567,106

DATED : October 22, 1996

INVENTOR(S) : Benno Gassner

It is certified that error appears in the above-indentified patent and that said Letters Patent is hereby corrected as shown below:

Col. 6, line 15, delete "dose" and substitute therefor -- does --

Signed and Sealed this

Tenth Day of June, 1997

*Attest:*

*Attesting Officer*

BRUCE LEHMAN

*Commissioner of Patents and Trademarks*